United States Patent [19]

Gordon et al.

[11] 4,253,005

[45] Feb. 24, 1981

[54] MICROWAVE SUPPRESSION APPARATUS

[75] Inventors: Paul J. Gordon, Windham, N.H.; E. Eugene Eves, II, Nabnasset; Richard H. Edgar, Chelmsford, both of Mass.

[73] Assignee: Raytheon Company, Lexington, Mass.

[21] Appl. No.: 76,015

[22] Filed: Sep. 17, 1979

[51] Int. Cl.[3] ..... H05B 9/06

[52] U.S. Cl. ..... 219/10.55 A; 219/10.55 D

[58] Field of Search ..... 219/10.55 A, 10.55 D, 219/10.55 F

[56] References Cited

U.S. PATENT DOCUMENTS

| | | | |
|---|---|---|---|
| 3,151,230 | 9/1964 | Britton | 219/10.55 A |
| 3,974,353 | 8/1976 | Goltsos | 219/10.55 A |
| 4,182,946 | 1/1980 | Wayne et al. | 219/10.55 A |

*Primary Examiner*—Elliot A. Goldberg
*Assistant Examiner*—Keith E. George
*Attorney, Agent, or Firm*—William R. Clark; Milton D. Bartlett; Joseph D. Pannone

[57] ABSTRACT

A microwave suppression apparatus having two lengthwise tunnels and a plurality of septums that sequentially move through both tunnels in a continuous loop. The septums form microwave seals with inner wall portions of the tunnels to prevent the leakage of microwave energy through an access opening in an energized enclosure. A conveyor which carries a product through the access opening to the energized enclosure also passes through one of the two tunnels of the suppression apparatus.

13 Claims, 3 Drawing Figures

MICROWAVE SUPPRESSION APPARATUS

BACKGROUND OF THE INVENTION

The use of microwave energy radiated within an enclosure to process materials has been in wide use for many years. The molecular agitation within the material resulting from its exposure to microwave energy provides frictional heat to cook or dry the material in a time period that is relatively short compared with other means of conventional heating. Typically, magnetrons and high power vacuum triodes provide the source of microwave energy.

Government agencies have allocated frequency bands centered at 915 and 2450 megahertz for use in microwave heating systems. The intensity of microwave energy permitted to leak from domestic and/or industrial microwave heating systems is restricted to less then 10 milliwatts per square centimeter. In the United States, for example, the Department of Health, Education and Welfare requires that microwave energy leakage from a domestic oven must not exceed 1 milliwatt per square centimeter in the factory or 5 milliwatts per square centimeter in the home. Further, the Occupational Safety and Health Administration requires a microwave energy exposure of less than 10 milliwatts per square centimeter. The International Microwave Power Institute has adopted a standard for intensity of microwave energy radiation leakage which is "less than 10 milliwatts per square centimeter". Accordingly, systems employing the use of microwave energy for processing of materials must have a means to prevent the leakage of the microwave energy from the enclosure.

Many industrial microwave heating applications require that there be access apertures into the enclosure so that materials may be transported therethrough with a conveyor. The suppression of microwave energy from these apertures has presented a problem which is more complex than the suppression of microwave energy from a batch oven.

One prior art approach to the suppression of microwave energy from a conveyorized microwave system was to line the inner walls of a tunnel which surrounded the aperture with a lossy material. The product would pass through the tunnel on a conveyorized system and the microwave energy would be absorbed by the lossy material. However, for large apertures, the system efficiency is relatively low because a substantial amount of energy is consumed by the lossy material. Further, if the mutually orthogonal dimensions of a cross-section of the tunnel are relatively large compared to a free space wavelength of the energy, the tunnel has to be prohibitively long to be an effective seal.

Another prior art approach to the problem is the use of a plurality of thin metal flaps that hang in the tunnel which has lossy walls. The flaps are pushed aside by the product as it passes through. The flaps however do not provide an effective seal when the tunnel cross-sectional mutually orthogonal dimensions are substantially greater than a free space wavelength of the microwave energy or when product pushing aside the flaps is not sufficiently lossy.

Another prior art approach is the use of reflectors which have dimensions substantially the same as the inner dimensions of the tunnel, said reflectors being attached to the conveyor system so that they substantially block the area of the tunnel as they pass through. Further, in U.S. Application Ser. No. 872,189, assigned to the same assignee herein, there is disclosed the use of a means for substantially preventing the transmission of the energy in the gap between the inner walls of the tunnel and the reflectors in a direction which is substantially perpendicular to the length of the tunnel. This approach, however, has two major disadvantages. First, because the reflectors are attached to the conveyor system, the reflectors themselves make it difficult to end load the conveyor. Accordingly, product loaded onto the conveyor by automated means must enter from the side, making the loading means of complex design to avoid contact with the moving reflectors. Second, because the reflectors are generally of a reflective material and structurally solid, the conveyor must be of a very heavy and rigid design to support the reflectors over the long continuous path.

SUMMARY OF THE INVENTION

The invention discloses a microwave energy suppression apparatus for substantially preventing the leakage of microwave energy from an access opening in a microwave energized enclosure. The apparatus comprises an elongated hollow structure having a portion divided into first and second lengthwise tunnels and means for moving reflectors in a continuous loop through the first and second tunnels, the reflectors providing microwave energy seals with inner wall portions of the tunnels. It is preferable that a conveyor be provided for moving product through the first tunnel into the enclosure by way of the access opening. It may also be preferable that the seals comprise means for preventing the transmission of microwave energy in the gap between the wall portions and the reflectors in a direction which is substantially perpendicular to the length of the hollow structure. More specifically, this direction may be around the periphery of a reflector and may comprise rows of conductive posts extending from the periphery of the reflectors. The reflectors themselves may be fabricated of conductive surfaces which form a rectangular box structure. Also, the moving means may comprise a chain supported on each lengthwise side of the hollow structure, the chain supporting the reflectors. The term "microwave" is defined to be electromagnetic wave energy having a free space wavelength in the range from 1 millimeter to 1 meter.

The invention may be practiced by the combination of an elongated conductive cavity having a central portion divided into first and second parallel tunnels, means for cycling a plurality of reflectors within the cavity through said first and second tunnels, the reflectors forming microwave seals with inner wall portions of the tunnels, and the cycling means comprising movable chains supporting the reflectors, each chain of which supported by wall portions of the tunnels.

BRIEF DESCRIPTION OF THE DRAWINGS

The foregoing and other objects and advantages of the invention will be understood more fully in the following detailed description thereof with reference to the accompanying drawings wherein.

DESCRIPTION OF THE PREFERRED EMBODIMENT

Figure 1:
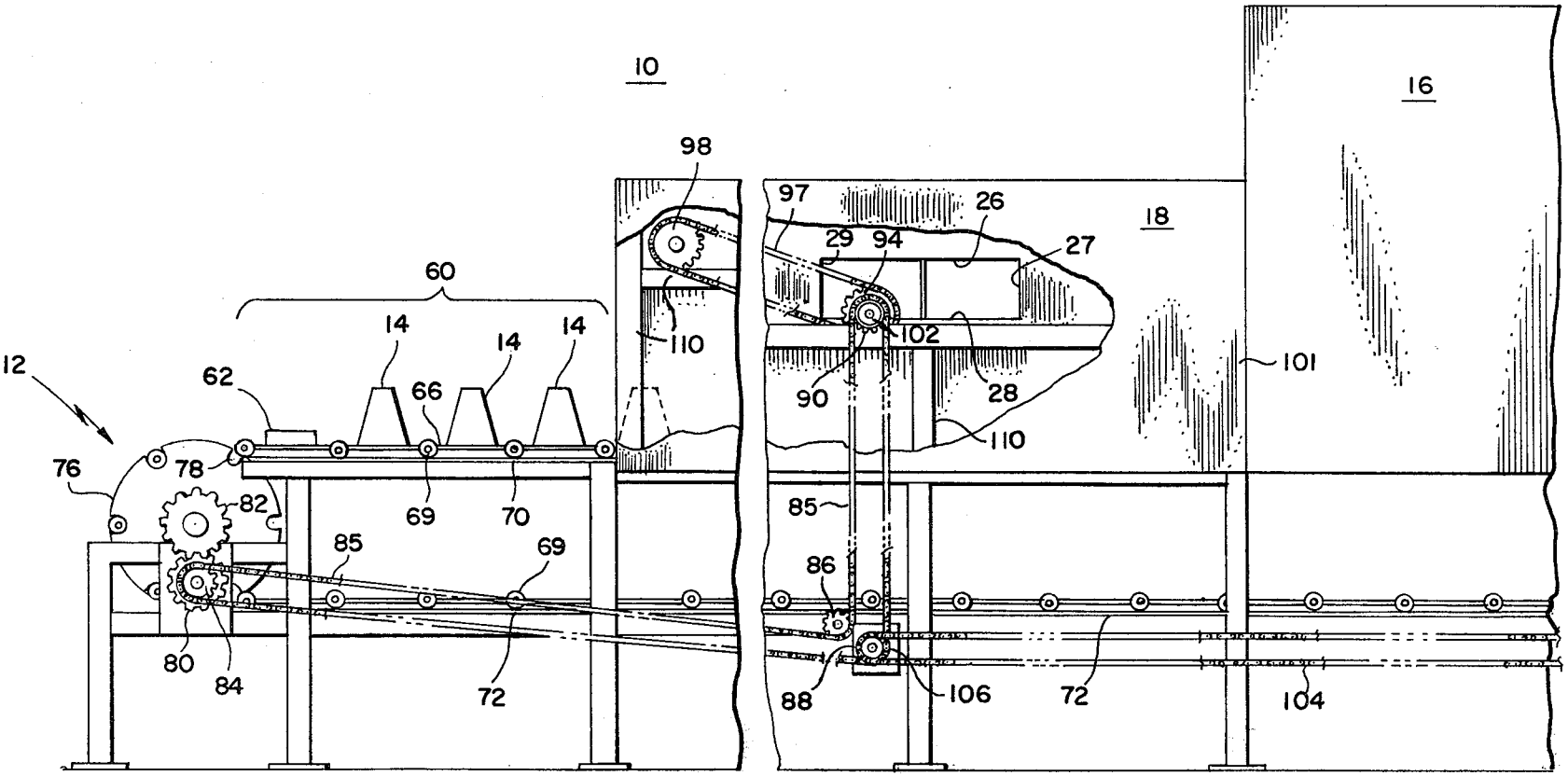
FIG. 1 is a side elevation view of the microwave energy suppression apparatus embodying the invention, a conveyor system, and a portion of the processing enclosure.

Referring to FIG. 1, a microwave drying apparatus 10 has a continuous loop transporting system 12 to move product 14 through enclosure 16. Enclosure 16 is energized with microwave energy for the processing of product passing therethrough on the continuous loop transporting system 12, such as a conveyor. Microwave energy suppression apparatus 18 is used to prevent the leakage of microwave energy through an access opening in enclosure 16 through which the conveyor moves materials into the processing region. Any conventional means may be used to introduce microwave energy such as that described in U.S. Application Ser. No. 872,189, assigned to the same assignee herein, and hereby incorporated by reference. Specifically, microwave energy may be introduced to enclosure 16 by a plurality of magnetrons (not shown), each of which is coupled directly into a radiating structure (not shown) which is mounted on the top and/or bottom of the enclosure. In the preferred embodiment, the magnetrons operate at a frequency of approximately 2450 megahertz although the allocated frequency of 915 megacycles may also be used. The interior dimensions of enclosure 16 are substantially greater than a free space wavelength of the energy. Further, in the enclosure, it may also be preferable to process the product with hot air which is heated by passing air across the magnetrons and their associated power supplies. The air may be exhausted through a duct (not shown) beneath the processing chamber in enclosure 16.

Figure 2:
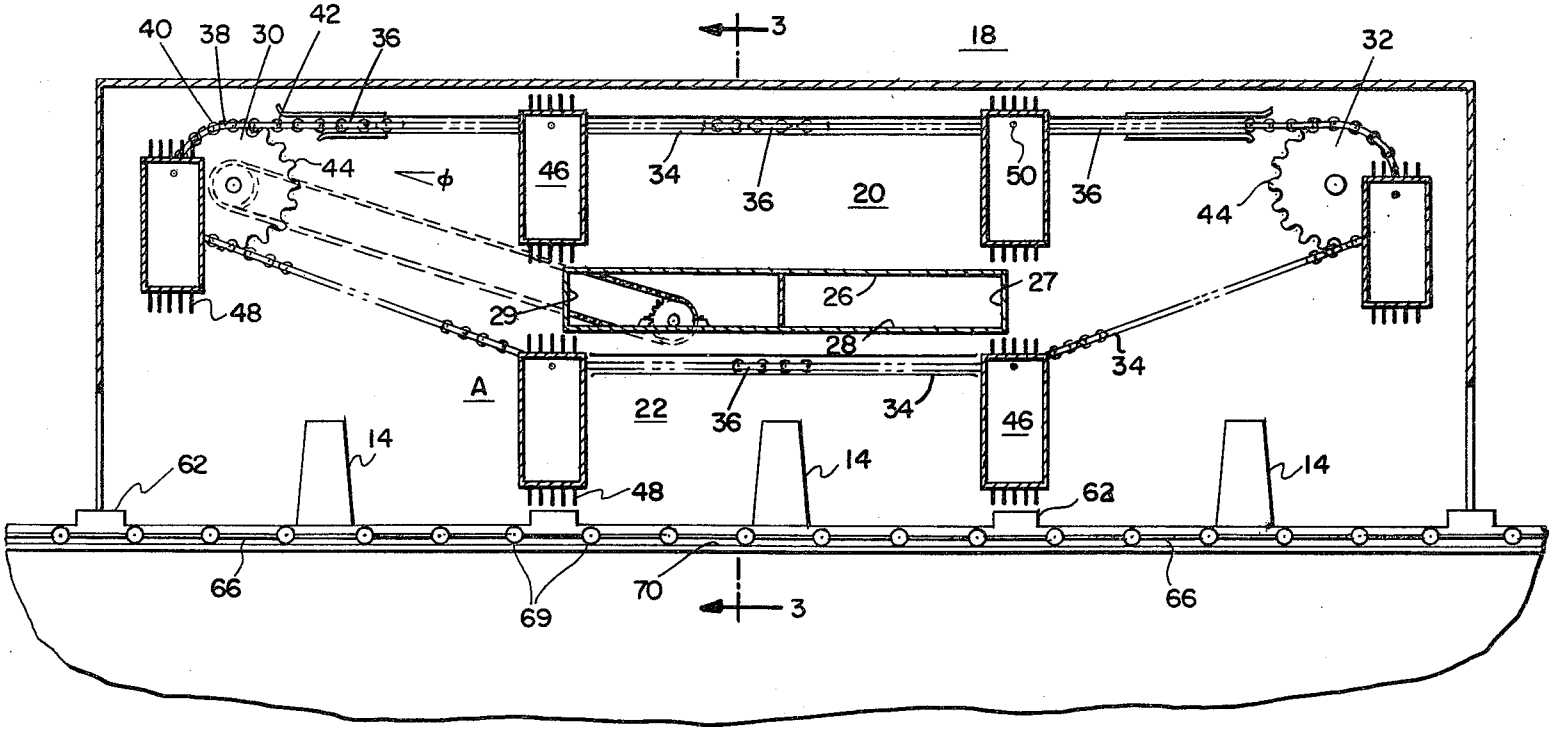
FIG. 2 is a sectional view of the microwave energy suppression apparatus.

Referring to FIG. 2, a sectional view of microwave energy suppression apparatus 18 is shown. The central portion of the tunnel is divided into an upper tunnel 20 and a lower tunnel 22. Separating the two tunnels is an aperture through the apparatus formed by conductive surfaces 26–29. On each side wall of the apparatus is a chain path consisting of sprocket 30, sprocket 32, and grooves 34 in the inner walls of the apparatus. A loop chain 36 is driven in the chain path by sprocket 30, the drive mechanism of which will be described in detail later herein. As seen in FIG. 2, as indicated by the arrows, the chain passes from sprocket 30, down an incline to a horizontal route through the lower tunnel, up an incline to sprocket 32, and back a horizontal route through the upper tunnel to sprocket 30. Chain 36, as can be viewed more easily in FIG. 3, consists of two rows of chain links 38 on each side of chain rollers 40 with the designated parts being secured together by chain pins 42 through the centers of the rollers. In operation, the teeth 44 of sprockets 30 and 32 insert between the rollers. Sprocket 32 is mounted on a plate (not shown) which can be secured in a plurality of horizontal positions; accordingly, the tension of chain 36 can be adjusted.

The function of chain 36 is to provide support and drive for six septums 46 which pass in a closed loop through the lower tunnel and upper tunnel. While in either of the tunnels, a septum provides a microwave seal to substantially prevent the leakage of microwave energy from the enclosure out through the access opening to the environment. The septums are equally spaced along chain 36 so that there is always at least one septum in each of the tunnels.

Figure 3:
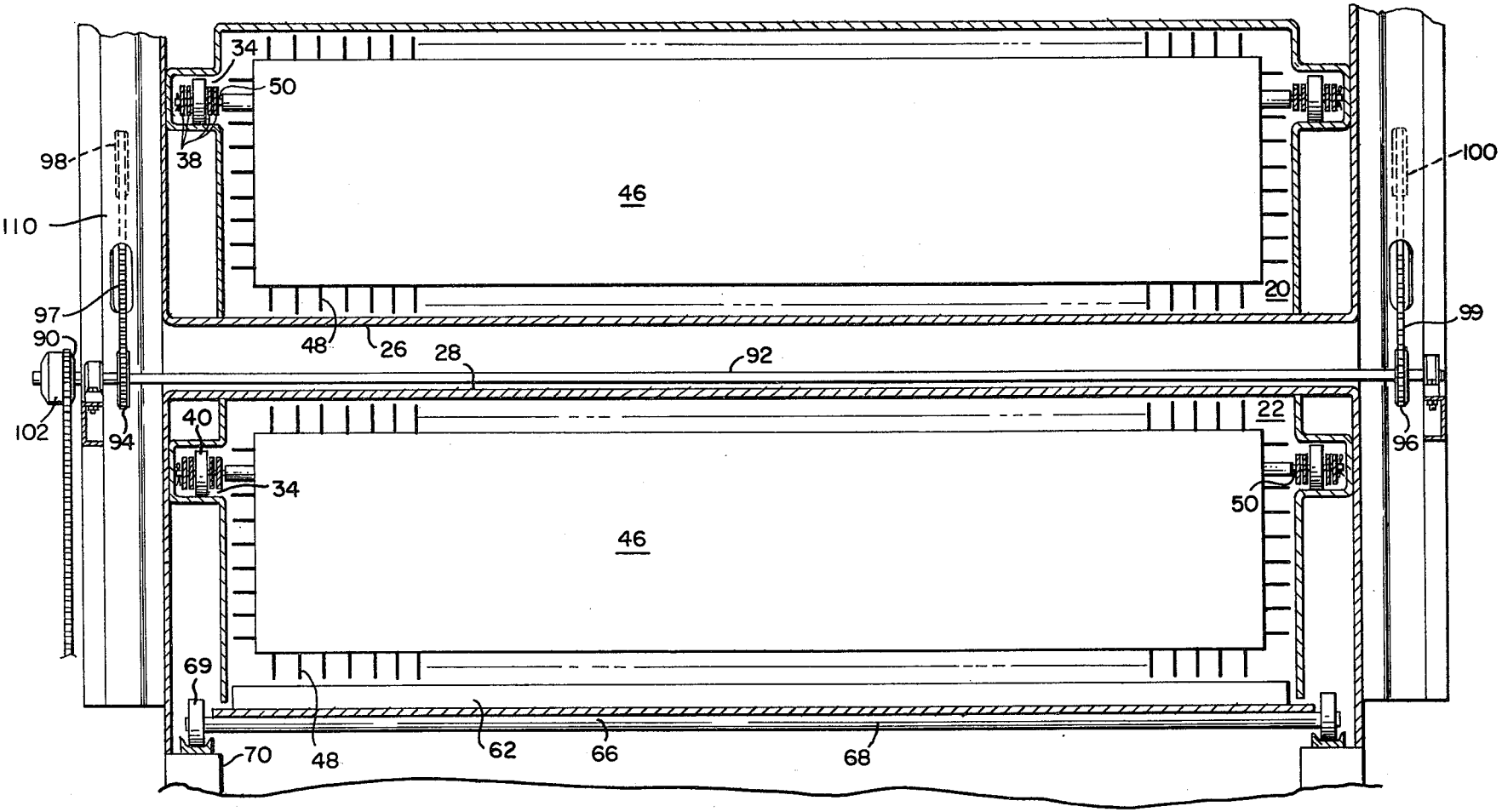
FIG. 3 is a front sectional view of the microwave energy suppression apparatus taken along lines 3—3 of FIG. 2.

A septum is fabricated of a conductive material that will reflect rather than be transparent or absorb microwave energy. The septum performs two functions. First, it provides a reflective shield to prevent the propagation of microwave energy from the access opening down through the central portion of either the upper or lower tunnel. For this purpose, it is preferable that the dimensions of a septum be such that it occupies a substantial portion of the cross-sectional area of the upper and lower tunnels as viewed from the access opening. It is apparent that the cross-sectional areas of the upper and lower tunnels must be substantially the same so that, sequentially, the same septum can substantially fill up each tunnel. In the preferred embodiment, the width of a septum as viewed from the access opening is 48 inches. The height of a septum is 9 inches and the thickness is 5 inches. The second function of a septum is provide an inner element for a seal which substantially prevents the propagation of microwave energy through the gap between the septum and either a tunnel wall or the product transporting system. This seal comprises five rows of cylindrical posts 48 which extend from the periphery of a septum as shown in FIGS. 2 and 3. The posts function similar to quarter wavelength guide stub in a microwave waveguide for energy incident in a direction parallel to the length of the tunnel. Additionally, with the arrangement of the posts into a "waffle iron" type structure, the sealing is essentially isotropic and has the same characteristic, at any given frequency, for TEM waves traveling through in any direction. Because any $TE_{MO}$ mode can be resolved into TEM waves traveling in different directions through the seal, the properties of the seal are a function of frequency only and not mode dependent. The posts are approximately one quarter of the free space wavelength long or 1.025 inches and they have a diameter of approximately 0.375 inches. For most applications, the gap should be less than 0.2 wavelengths. The center of each post is 1.125 inches from the centers of the closest adjacent posts. Further, the spaces between the posts in the peripheral direction inhibit peripheral mode transmission as discussed in U.S. Pat. No. 3,767,884 which issued to J. M. Osepchuk on Oct. 23, 1973. As described therein, the inhibiting restricts propagation down the tunnel in the gap between the periphery of a septum and the inner walls of a tunnel to the extent that substantially all microwave energy in the tunnel is reflected back toward the enclosure.

Referring to FIG. 3, a sectional front elevation of the suppression apparatus taken along lines 3—3 of FIG. 2 is shown. The position of septums is shown in the upper tunnel and lower tunnel. Each septum is supported by two support pins 50 that extend into chains 36 at the two sides of the tunnels in the place of chain pins 42. The septum is free to pivot on the support pins 50 so that it is always in a vertical attitude as shown in FIG. 2; this is caused by the center of gravity of the septum being lower than the pivot line between the support pins 50. Chain 36, as described earlier herein, is formed by two rows of chain links 38 on both sides of a row of rollers 40. The piece parts are secured together by chain pins 42 through the centers of the rollers.

In operation, product 14 is placed on the conveyor of the product transporting system at a loading station 60. It is important that the septums are not connected to the conveyor; this feature makes possible end loading which may be accomplished by automated machinery. Risers 62, which are spaced apart the same distance as septums, are provided on the conveyor to designate those areas on the conveyor where product cannot be loaded; the risers in combination with the septums form the microwave seals. The product then moves into the lower tunnel of the suppression apparatus where septums come down an incline to form seals with the risers. It can be seen that for the length of the lower tunnel, the septum and hence the chain must move at the same speed as the conveyor for the two to remain aligned. Further, because the movement from sprocket 30 to point A is not parallel to the conveyor, it must be at a slower speed in the horizontal direction than the speed of the chain through the lower tunnel. Therefore, there is a limitation wider than a riser as to where product can be placed on the conveyor so as not to be contacted by a descending or ascending septum. This limitation is in part a function of the height of the product and the angle of descent or ascent. As the angle $\phi$ of descent of a septum is increased, the available product area is reduced. As the angle $\phi$ of descent of a septum is decreased, the product area is increased but the suppression apparatus must be made longer. It was found that descent and ascent angles of 20° were preferable for the particular application of drying foundry cores considering the height of the product.

The conveyor comprises a plurality of steel plates 66 having dimensions 48×9 inches. Along the 48-inch side, the edges are rolled down and cut out so as to interleave with adjacent plates with an axle 68 positioned therethrough to hold the plates 66 together. On the ends of the axles are positioned wheels 69 which roll in upper tracks 70 and lower tracks 72 to provide a continuous loop. The steel plates which are ⅛ inch thick have a plurality of ¼ inch holes (not shown) to provide for hot air flowing therethrough while within the enclosure, as described earlier herein; the holes do not permit the passing of microwave energy. Large sprockets 76 are provided at both ends of the product transporting system to provide a conveyor loop. Indentations 78 in sprocket 76 engage the axles between the wheels and the steel plates and reverse the direction of the conveyor.

The speed and position of the septums in lower tunnel 22 must be synchronized to the speed of the conveyor to insure that the septums do not come in contact with product that is placed on the appropriate area of the conveyor. The speed is synchronized by linking chain 36 and drive sprocket 30 to the conveyor system. Again referring to FIG. 1, gear 80 is coupled to gear 82 which is connected to sprocket 76. On the same axle of gear 80 is sprocket 84 which drives a chain 85 around sprockets 86 and 88 to sprocket 90. As shown in FIG. 3, sprocket 90 is connected to axle 92 which is positioned through the suppression apparatus and has sprockets 94 and 96 on opposite sides of the apparatus. Sprockets 94 and 96 are connected by chains 97 and 99 to sprockets 98 and 100, respectively, which are mounted on the outside walls of the apparatus. Sprockets 98 and 100 are connected to axles which extend through the apparatus side walls to sprocket 30 and its corresponding sprocket on the opposite wall, respectively. Accordingly, the use of axle 92 insures that both sides of chain 36 are driven at the same speed. The gear and sprocket ratios of the parts so described are chosen so that a septum when moving in the upper or lower chamber in a horizontal direction is moving at the same speed as the conveyor belt to which it is parallel. The alignment of the septums to risers is adjusted by an angular adjustable hub 102 on sprocket 90. Chain 104 connected to sprocket 106, which is on the same axle as sprocket 88, provides a drive to a suppression apparatus at the other end of the enclosure 16.

The drive for sprocket 76 can be any appropriate conventional type. In the preferred embodiment, an electric drive motor (not shown) producing 1750 revolutions per minute is coupled to a variable drive reducer which provides adjustable output from 0 to 400 revolutions per minute. The variable drive reducer is coupled to a cyclo-drive reducer (not shown) with a fixed ratio of 40 to 1. The cyclo-drive reducer is coupled to a sprocket (not shown) on the opposite end of the axle of sprocket 76 by a chain drive (not shown). In the preferred embodiment, sprocket 76 is covered over with protective covering for safety. Cover 108 is positioned over the support structure 110 for safety. Also, for safety, a photo detector system (not shown) is provided as an interlock to insure that the septums align with risers in the lower tunnel and that there is no product placed in the riser zone where it could cause a septum to list, resulting in microwave leakage. Briefly, a light beam directed across the upper tunnel to a photo detector is interrupted by a moving septum; this event is used to time the inspection by another light beam directed across the conveyor at a riser to insure that no product is positioned thereon.

This concludes the description of the preferred embodiment. Many modifications and alterations will be obvious to those skilled in the art without departing from the spirit and scope of the invention. Therefore, it is intended that the scope of the invention be limited only by the appended claims.

What is claimed is:

1. A microwave energy suppression apparatus for substantially preventing the leakage of microwave energy from an access opening in a microwave energized enclosure, comprising:

an elongated hollow structure divided into first and second lengthwise tunnels; and means for moving reflectors in a continuous loop through said first and second tunnels, said reflectors providing microwave energy seals with inner wall portions of said tunnel.

2. The apparatus recited in claim 1 further comprising a conveyor for moving product through said first tunnel into said enclosure.

3. The apparatus recited in claim 1 wherein said seals comprise means for preventing the transmission of microwave energy in the gap between said wall portions and said reflectors in a direction substantially perpendicular to the length of said hollow structure.

4. The apparatus recited in claim 3 wherein said preventing means comprises rows of conductive posts extending from the periphery of said reflectors.

5. The apparatus recited in claim 4 wherein said reflectors comprise rectangular box structures fabricated from conductive surfaces.

6. The apparatus recited in claim 3 wherein said moving means comprises a chain supported on each lengthwise side of said hollow structure, said chain supporting said reflectors.

7. A microwave energy suppression apparatus for substantially preventing the leakage of microwave energy from a continuous access opening in a microwave energized enclosure, comprising:

an elongated conductive cavity having a central portion divided into first and second parallel tunnels; and means for cycling a plurality of reflectors within said cavity through said first and second tunnels, said reflectors forming microwave seals with inner wall portions of said tunnels.

8. The apparatus recited in claim 7 wherein said cycling means comprises two movable chains supporting said reflectors, said chains forming a loop through said first and second tunnels.

9. The apparatus recited in claim 8 further comprising a conveyor for moving product through said first tunnel into said enclosure.

10. The apparatus recited in claim 7 wherein said seals comprise means for preventing the transmission of microwave energy in the gap between said wall portions and said reflectors in a direction substantially perpendicular to the length of said hollow structure.

11. The apparatus recited in claim 10 wherein said preventing means comprises a plurality of rows of conductive posts extending from the periphery of said reflectors.

12. In combination:

an elongated conductive cavity having a central portion divided into first and second parallel tunnels extending in the lengthwise direction of said cavity;

a conveyor for carrying product through said first tunnel into a microwave energized enclosure by way of an access opening;

a plurality of conductive reflectors having rows of conductive posts around the periphery; and means for moving said reflectors through said first and second tunnels in a continuous loop to form microwave seals with inner wall portions of said tunnels and said conveyor.

13. The combination in accordance with claim 12 wherein said moving means comprises a pair of chains each of which is supported on a side wall of said cavity and passes through said first and second tunnels.

* * * * *